US006145140A

United States Patent [19]

Fernie et al.

[11] Patent Number: 6,145,140

[45] Date of Patent: Nov. 14, 2000

[54] BATHTUB

[75] Inventors: Geoffrey Roy Fernie, Etobicoke; Brian Peter Doyle, Toronto, both of Canada

[73] Assignee: Showerwall Industries Inc., Thunder Bay, Canada

[21] Appl. No.: 08/801,815

[22] Filed: Feb. 14, 1997

[51] Int. Cl.[7] ..... A47K 3/02

[52] U.S. Cl. ..... 4/577.1; 4/590; 4/593

[58] Field of Search ..... 4/576.1, 577.1, 4/578.1, 579, 584, 589, 590, 538, 592, 593, 594; D23/277

[56] References Cited

U.S. PATENT DOCUMENTS

| | | | |
|---|---|---|---|
| D. 148,393 | 1/1948 | Schladermundt et al. | 4/538 X |
| 172,605 | 1/1876 | Burdett | 4/584 X |
| D. 203,803 | 2/1966 | Tecton | D23/277 |
| 1,432,916 | 10/1922 | Schwartz | 4/590 |
| 2,052,628 | 9/1936 | Higgins | 4/578.1 |
| 2,063,864 | 12/1936 | Zinkil | 4/577.1 |
| 2,122,245 | 6/1938 | Callahan | 4/590 X |
| 2,168,079 | 8/1939 | Zinkil | 4/590 |
| 2,468,347 | 4/1949 | Restall | 4/584 |
| 2,815,513 | 12/1957 | Tilson et al. | 4/576.1 |
| 4,316,294 | 2/1982 | Baldwin | 4/584 X |

FOREIGN PATENT DOCUMENTS

| | | | |
|---|---|---|---|
| 1420148 | 10/1965 | France | 4/584 |
| 3702716 | 3/1988 | Germany | 4/584 |

*Primary Examiner*—Robert M. Fetsuga
*Attorney, Agent, or Firm*—George A. Seaby

[57] ABSTRACT

A bathtub for the elderly or physically infirm includes several important innovations, namely a narrow front wall at one end of the bathtub permitting easy access to the bathtub, a wide front platform at the other end of the bathtub, and a plurality of sockets in the top wall of the bathtub for mounting accessories on the bathtub. The accessories include a railing extending around the ends and rear of the bathtub, with a headrest at one end of the railing, an inverted U-tube for mounting proximate the center of the bathtub for use when entering or exiting the bathtub, a seat assembly which can be fixed in one position extending transversely of the bathtub or rotated outwardly to a non-use position, and a backrest for releasable mounting on the seat assembly, so that the seat assembly and the backrest can form a compact unit for storage under the platform.

11 Claims, 13 Drawing Sheets

BATHTUB

BACKGROUND OF THE INVENTION

1. Field of the Invention

This invention relates to a bathtub, and in particular to a bathtub specifically designed for the elderly and physically infirm persons.

2. Discussion of the Prior Art

In the past, there have been a great many proposals for special purpose bathtubs, particularly intended for use by physically infirm persons. Examples of such bathtubs are described in U.S. Pat. No. 4,254,516, which issued to H. A. V. Johansson on Mar. 10, 1981; U.S. Pat. No. 4,296,508, which issued to M. J. Moran on Oct. 27, 1981; U.S. Pat. No. 4,669,133, which issued to K. Blecher et al on Jun. 2, 1987; U.S. Pat. No. 5,101,521, which issued to R. H. Levien on Apr. 7, 1992, and U.S. Pat. No. 5,230,108, which issued to J. C. Perantoni et al on Jul. 27, 1993.

As a result of discussions with the elderly, the present inventors determined that in spite of the large number of different bathtubs presently available and/or described in the literature there are certain desirable features lacking from existing bathtubs. Following the discussions, the inventors designed a bathtub to meet the needs of the elderly.

GENERAL DESCRIPTION OF THE INVENTION

An object of the present invention is to provide a relatively simple bathtub, which is easy to enter and exit, and which provides user comfort.

Another object of the invention is to provide a bathtub with sockets in a top wall thereof facilitating the mounting accessories, including railings, a seat assembly and a backrest.

Accordingly, the present invention relates to a bathtub comprising:

(a) reservoir means, said reservoir means having an open top end and including bottom wall means, front wall means, rear wall means and first and second end wall means;

(b) top wall means contiguous with said front wall means, said rear wall means and said end wall means, said top wall means completely surrounding said open top end of said reservoir means;

(c) apron means extending downwardly from a front edge of said top wall means and defining a front of the bathtub; and (d) platform means integral with said top wall means and projecting outwardly from one end thereof.

BRIEF DESCRIPTION OF THE DRAWINGS

The invention will be described in greater detail with reference to the accompanying drawings, which illustrate a preferred embodiment of the invention, and wherein.

DESCRIPTION OF THE PREFERRED EMBODIMENT

Figure 1:
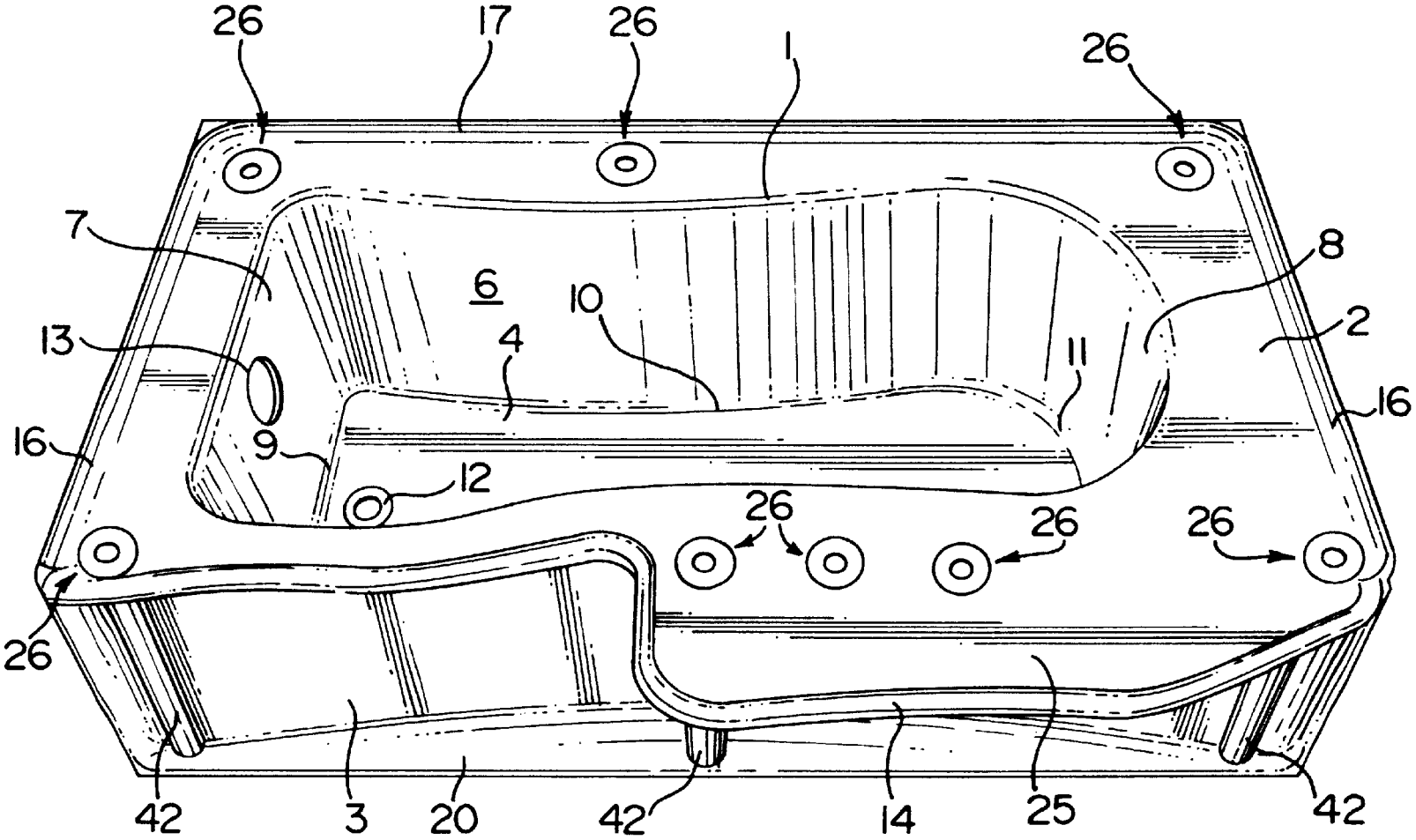
FIG. 1 is a perspective view of a bathtub in accordance with the present invention.

With reference to FIGS. 1 to 5, the bathtub of the present invention includes an elongated, one-piece molded body 1 defining a reservoir for receiving water, a top wall 2 integral with the body 1, and a apron 3 defining the front wall of the bathtub integral with the body 1 and the top wall 2.

The body 1 is defined by a planar bottom wall 4, a front wall 5, a rear wall 6, and end walls 7 and 8 integral with the bottom wall. The bottom wall has a straight end 9, slightly concave side edges 10 and a generally semicircular end 11. A conventional drain 12 is provided in the bottom wall 4 near the straight end 9. An opening 13 for a lever (not shown) to close a plug in the drain is provided in the straight end wall 6. The end wall 7 which is generally trapezoidal, has a steep slope, and the front walls 5 the rear wall and the semicircular end wall 8 have a more gentle upward and outward slope. The curvature of the fillet between the bottom wall 4 and the end wall 7 is much sharper than between the bottom wall 4 and the curved end wall 8. The curvature of the fillet increases gradually from the square end to the round end. In other words, the square end of the bathtub has a large flat bottom area for receiving a user, and the other end is more rounded for user comfort when sitting or reclining.

Figure 6:
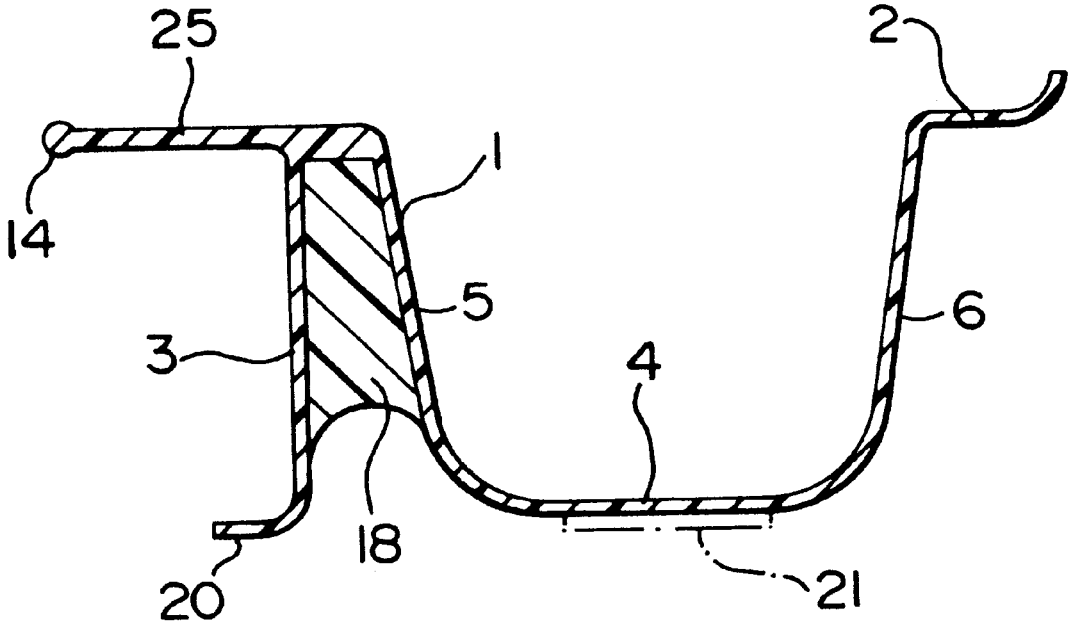
FIG. 6 is a cross section taken generally along line VI—VI of FIG. 2.

The top wall 2, which is generally rectangular with an irregular front or outer edge 14 extends outwardly from and completely around the upper edges of the front, rear and end walls. The ends 16 and the inner or rear edge 17 of the top wall 2 include upwardly curving, concave flanges for facilitating sealing of the tub against or in walls (not shown) constructed to receive the tub. The apron 3 which defines the front wall of the tub is generally rectangular, curving or bowed inwardly in a shallow concave arc from one end of the bathtub to the other. The apron 3 is spaced apart from the body 1, and the space can be filled with polyurethane foam 18 reinforcement (FIG. 6). Thus, the apron 3 supports the top wall along its entire length. The apron 3 has an outwardly concave bottom end 20 which curves into a horizontal flange facilitating sealing with a floor. Because the apron 3 is concave the flange is widest at the middle of the front edge. As shown in FIG. 6, the body 1 of the bathtub is not as high as the apron 3. Accordingly, when installing the bathtub, a board 21 is placed beneath the bottom wall 4 to support the body or reservoir portion of the bathtub. The outer edge 14 of the top wall 2 is beaded i.e. generally convex to present a smooth entry to the tub. The edge 14 includes a slightly concave end defining a narrow ledge 23 (which is part of the top wall 2) at the square end of the tub facilitating stepping into the tub. For this purpose, a shallow concave depression 24 (FIG. 3) is provided in the ledge 23. The top wall 2 also includes a substantially wider platform 25 at the other, semicircular end of the tub body 1. Both the ledge 23 and platform 25 extend outwardly beyond the front wall of the body 1 and beyond the supporting apron 3.

Figure 2:
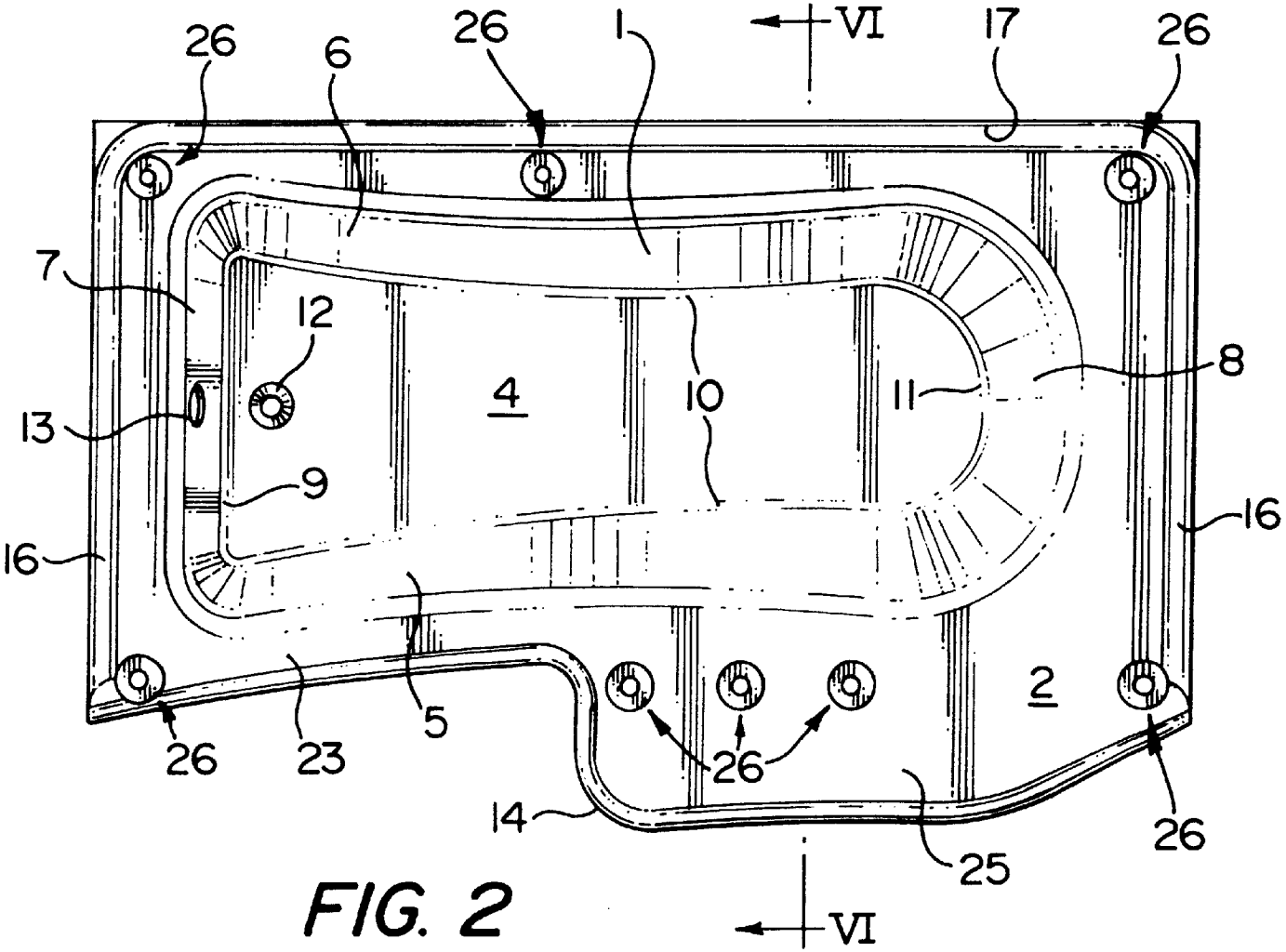
FIG. 2 is a top view of the bathtub of FIG. 1.
Figure 3:
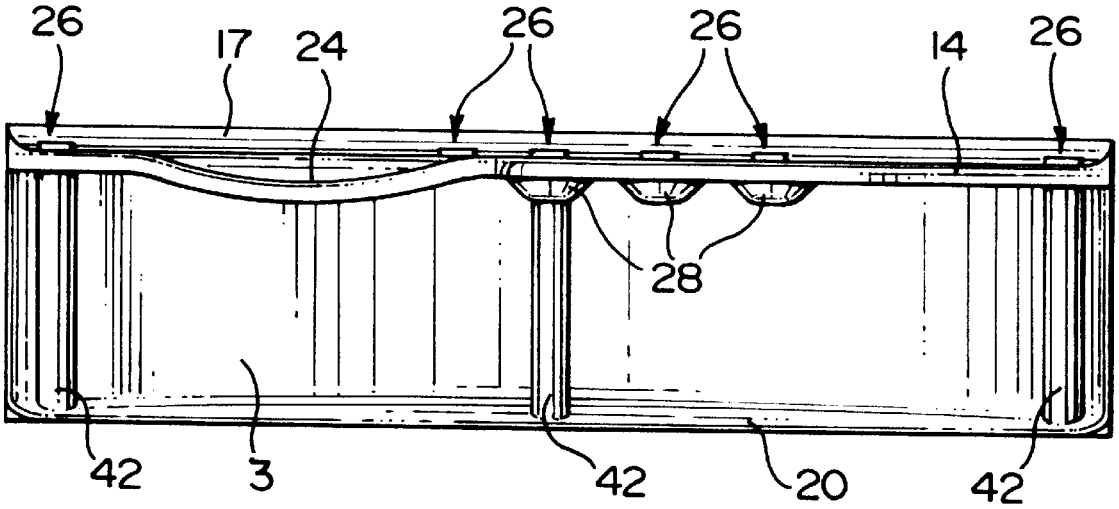
FIG. 3 is a front view of the bathtub of FIG. 1.
Figure 4:
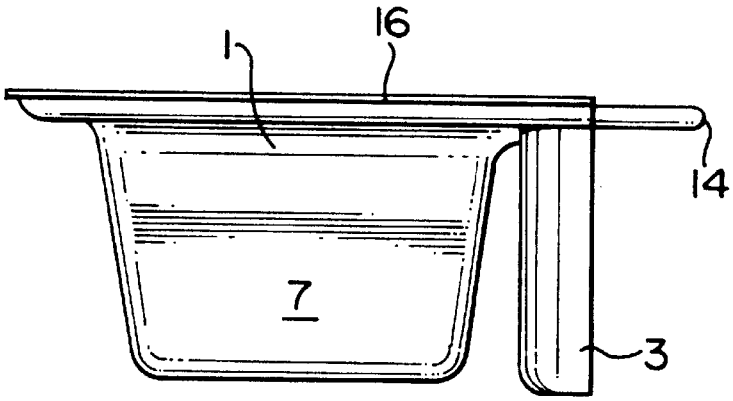
FIGS. 4 and 5 are end views of the bathtub of FIG. 1.
Figure 5:
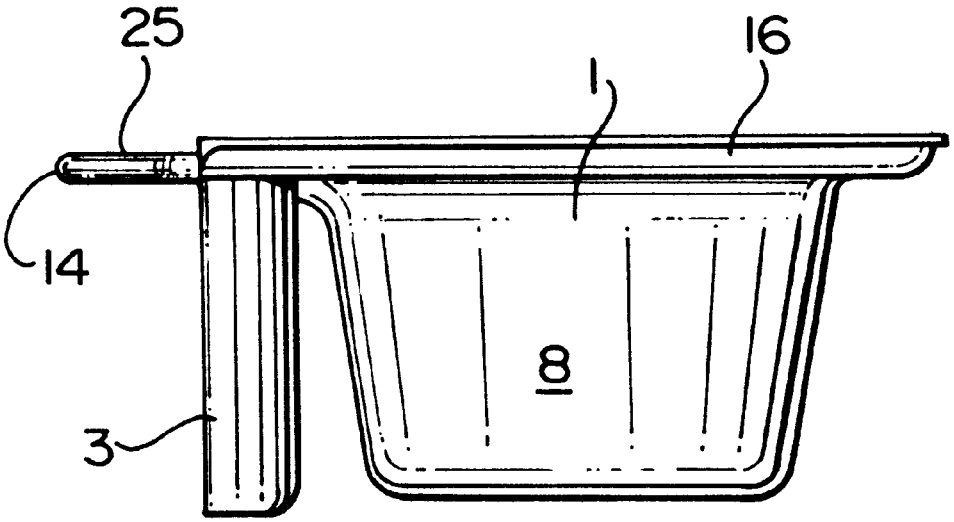

As clearly illustrated in FIGS. 4 to 6, the platform 25, which is integral with the top wall 2, is cantilevered outwardly from the front wall 5 of the reservoir and the apron 3, and extends slightly more than one-half the length of the bathtub (FIGS. 1 to 3). The platform 25 can be used when getting into the bathtub, when soaking the feet or legs in the tub or when drying in a sitting position. A plurality of sockets generally indicated at 26 are provided in the top wall 2 for supporting a variety of accessories described hereinafter in greater detail.

Figure 7:
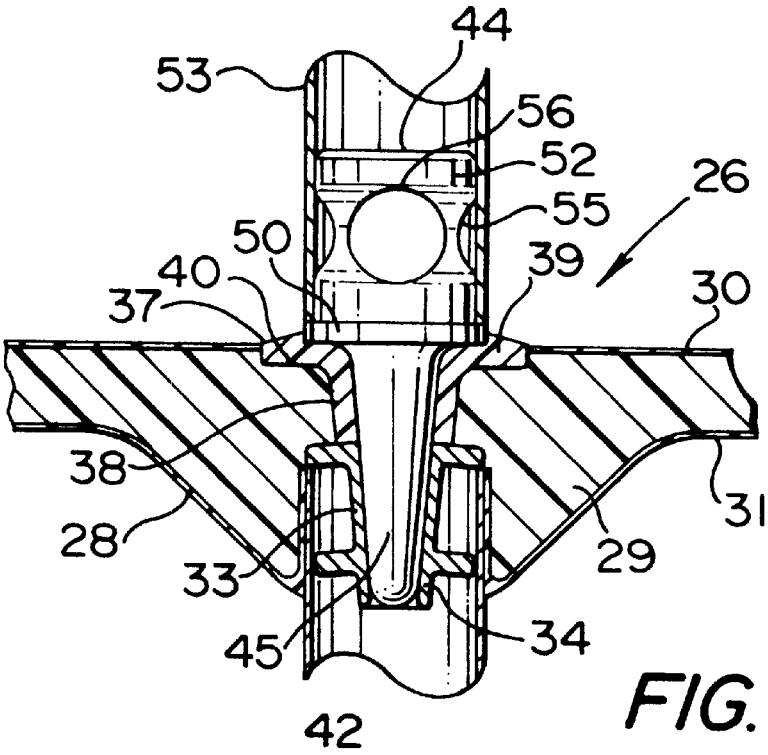
FIG. 7 and 8 are cross sections of tube mounting sockets used in the bathtub of FIGS. 1 to 5.
Figure 8:
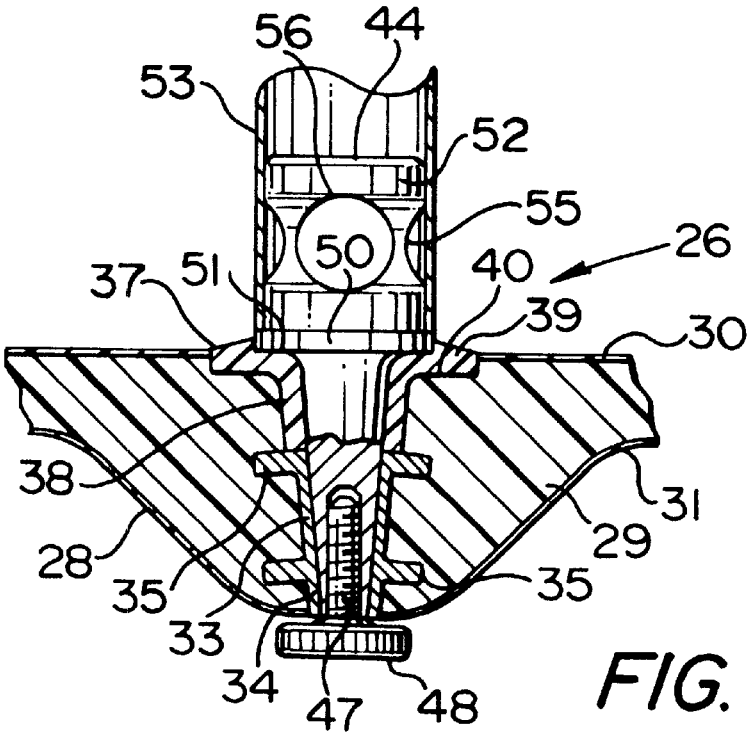

Because most of the accessories are supported by posts or tubes extending downwardly through the top wall 2, it is necessary to reinforce the sockets 26 in one manner or another. As shown in FIGS. 3, 7 and 8, three of the sockets 26 in the front of the top wall 2 extend through reinforcing projections 28. The projections 28, which extend downwardly from the platform 25, are formed by dense polyurethane foam 29 sandwiched between the hard top and bottom layers 30 and 31 of the platform 25. A steel bottom reinforcing insert 33 is incorporated into the platform sockets 26. The insert 33 includes a tubular frusto-conical body 34, and spaced apart annular ribs 35 extending into the foam for anchoring the insert 33 in the projection 28. A hard polyurethane top insert 37 is provided in each of the platform sockets 26. Each insert 37 includes a tubular, frusto-conical body 38, the top end of which flares outwardly to define an annular flange 39. The flange 39 rests in an annular recess 40 around the socket 26 in the top wall 2. In the case of one of the platform sockets 26 and the apertures at the front corners of the apron 3, the sockets form the open top end of long metal tubes 42.

The inserts 33 and 37 receive aluminum plugs 44. Each plug 44 includes a generally conical bottom end 45 for sliding insertion into the inserts 33 and 37. In the case of the lefthand socket 26 (FIGS. 3 and 7) in the center of the platform 25, the bottom insert 33 is housed in the top end of the tube 42, and no screw is used. In the other cases (FIG. 8), the plug 44 is retained in the inserts 33 and 37 by a thumbscrew 47, which is inserted into a threaded recess in the bottom end of the plug. The knurled head 49 of the screw 47 limits movement of the screw 47 into the plug. A flange 50 on the top end of the plug seats in a recess 51 in the top insert 37. A cylindrical head 52 is provided on the upper end of the plug for mating with the bottom end of a tube 53. For such purpose, the edge of the top end of the head 52 is bevelled to facilitate coupling. An annular groove 55 and a diametrically extending hole 56 are provided in the head 52 of the connector. The hole 56 receives a bolt (not shown) for securing the tube 53 on the plug 44.

Figure 9:
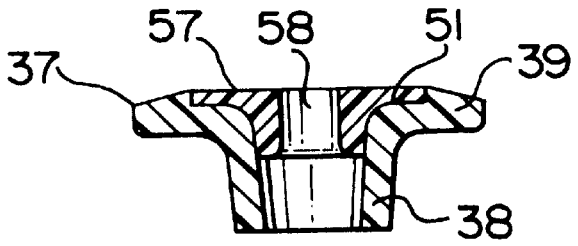
FIG. 9 is a cross section of a cap used on the sockets of FIGS. 7 and 8.

When not in use, the sockets 26 are partially closed by a plastic cap 57 (FIG. 9) which is seated in the recess 51 in the top insert 37 so that the top surface of the cap is flush with the top surface of the top insert 37. A hole 58 is provided in the center of the cap 57.

Figure 10:
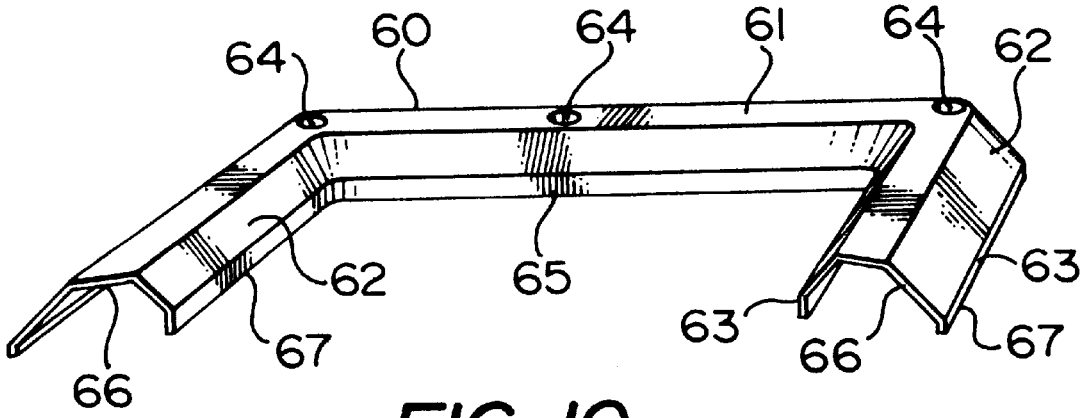
FIG. 10 is a perspective view of a base support used in the bathtub of FIGS. 1 to 5.

Referring to FIG. 10, a generally U-shaped base support 60 is provided for mounting on a floor (not shown) beneath the ends and the inner or rear portion of the top wall 2. The support 60, which is generally C-shaped, includes a flat top surface 61, sloping shoulders 62, and vertical side walls 63. Cylindrical sockets 64 are provided at the corners and in the longer middle section 65 of the support 60 for receiving various posts (as described hereinafter in greater detail). The free ends 66 of the arms 67 of the support 60 are inclined with respect to a plane parallel to the middle section 65 for smoothly abutting the concave inner surface of the apron 3. The ends 66 are attached to the apron 3 for properly locating the support 60 beneath the rear and ends of the top wall 2, i.e. for aligning the sockets 64 with the three sockets 26 adjacent to the rear edge 17 of the bathtub top wall 2.

Figure 11:
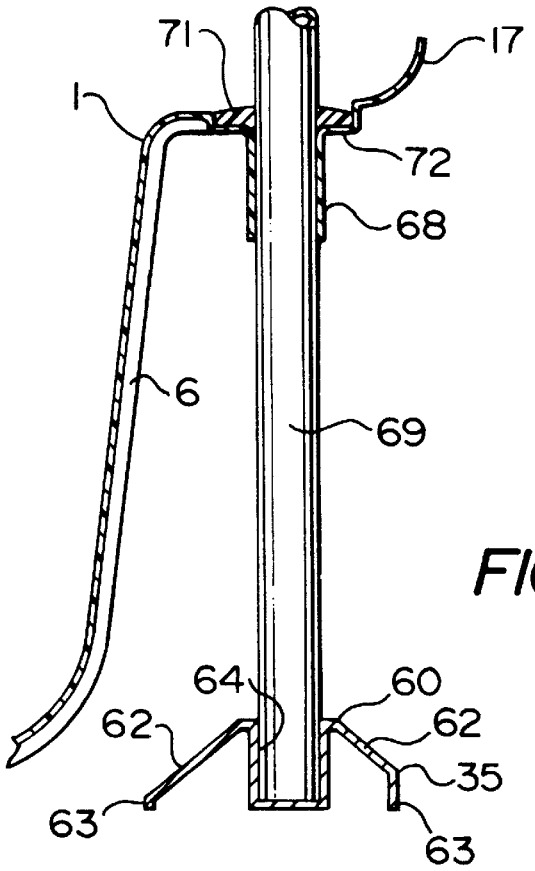
FIG. 11 is a cross-sectional view of the rear center of the bathtub of FIG. 1 showing the support of FIG. 10 in use.
Figure 12:
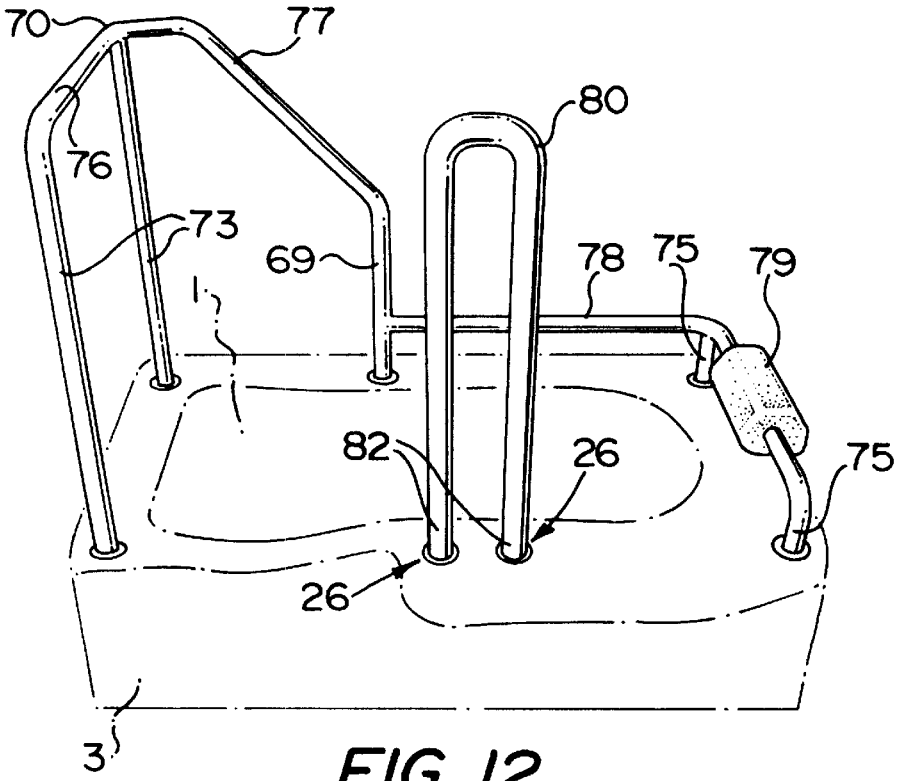
FIG. 12 is a perspective view of one set of accessories used on the bathtub of FIGS. 1 to 5.

Referring to FIG. 11, the socket 26 in the rear center of the top wall 2 is defined by a sleeve 68 integral with the top wall and extending downwardly therefrom for receiving a post 69, which forms part of a one-piece railing 70 (FIG. 12). A hard, rectangular, polyurethane reinforcing insert 71 is mounted in a recess 72 around the open top end of the sleeve. A silicon seal (not shown) is provided between the sleeve 68 and the post 69. As mentioned above, the post 69 extends downwardly into one of the sockets 64 in the base support 60.

As best shown in FIG. 12, the railing 70 includes two long posts 73 mounted in the corners of the square end of the bathtub, an intermediate length post 69 mounted in the rear of the top wall close to the center of the bathtub and a pair of short posts 75 mounted in the corners of the round end of the bathtub. The tops of posts 73 and 69 are interconnected by a rail 76 extending around the rear of the square corner of the bathtub. The rear arm 77 of the rail is inclined. A second, L-shaped rail 78 extends from the post 69 around the other rear corner of the bathtub. An elongated headrest 79 of polygonal cross section is mounted on the rail 78 at the round end of the bathtub.

Figure 13:
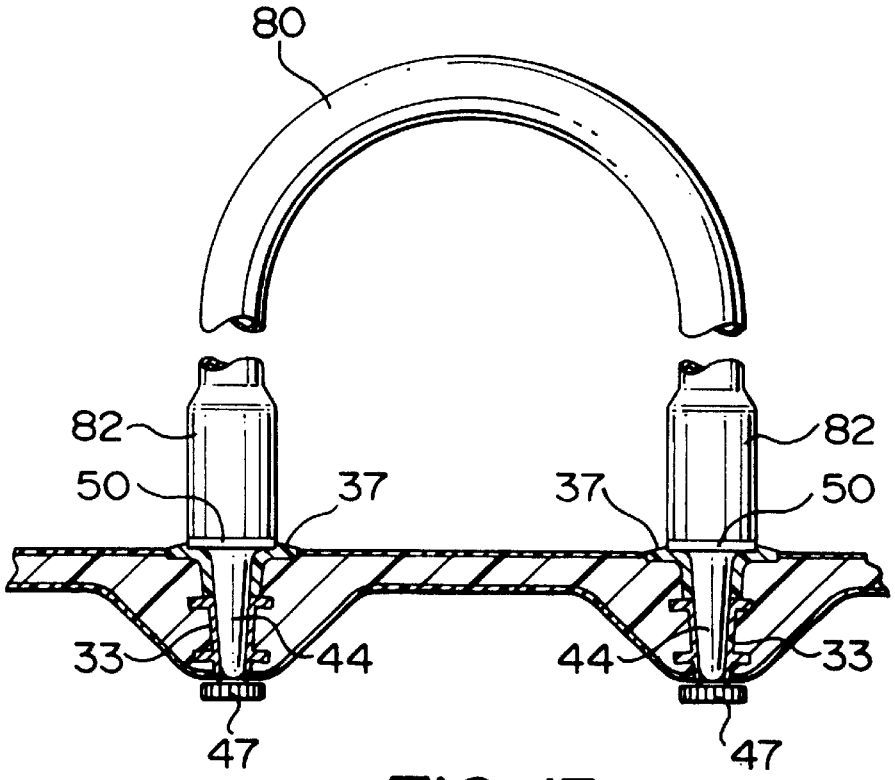
FIG. 13 is a cross-sectional view of the bottom end of one of the accessories of FIG. 12.

An inverted U-tube 80 is mounted at the front of the top wall 2 proximate the center thereof, i.e. at one end of the platform 25. The tube 80 facilitates entry and exiting of the bathtub. The ends 82 of the tube 80 are mounted on the platform 25 using the aluminum plugs 44 (FIGS. 7 and 8). It will be noted that the tube 80 in FIG. 13 is different from the tube shown in FIG. 12. The ends 82 are larger diameter only when required for receiving a plug 44.

Figure 14:
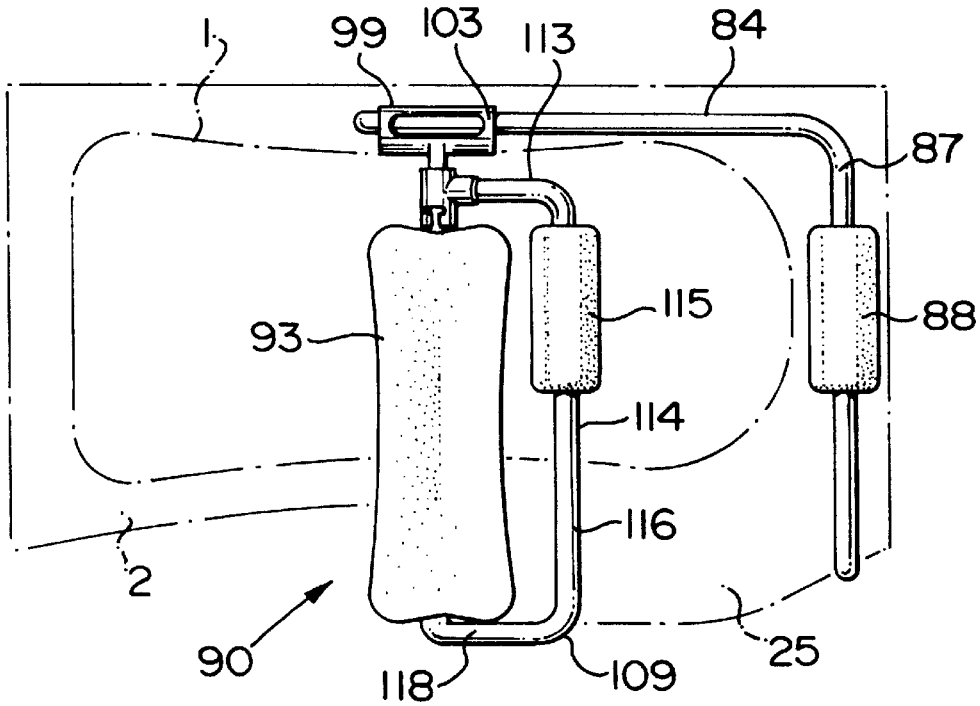
FIG. 14 is a top view of a second set of accessories used on the bathtub of FIGS. 1 to 5.
Figure 15:
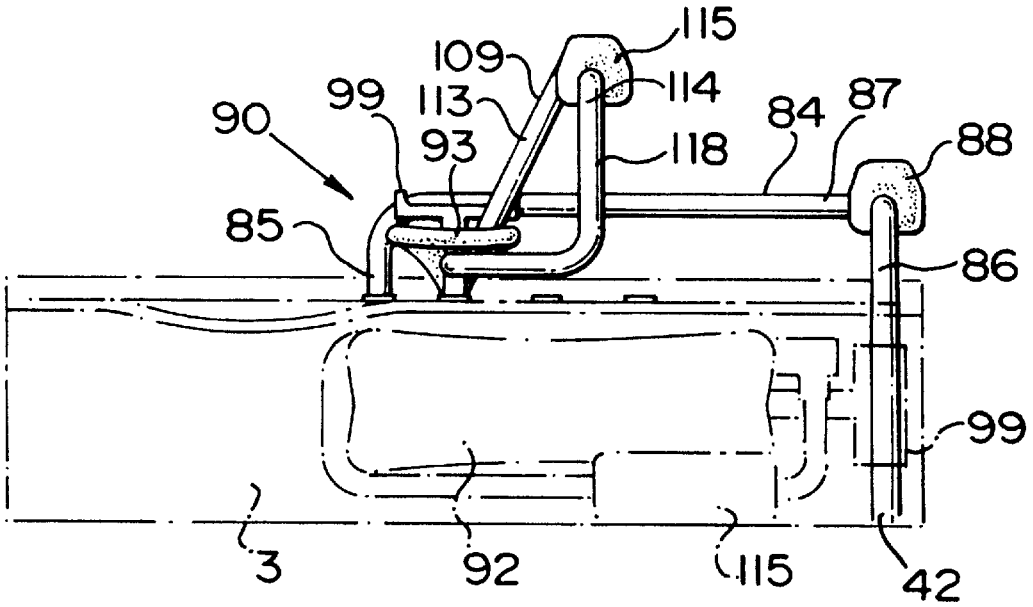
FIG. 15 is a side view of the accessories of FIG. 14.
Figure 16:
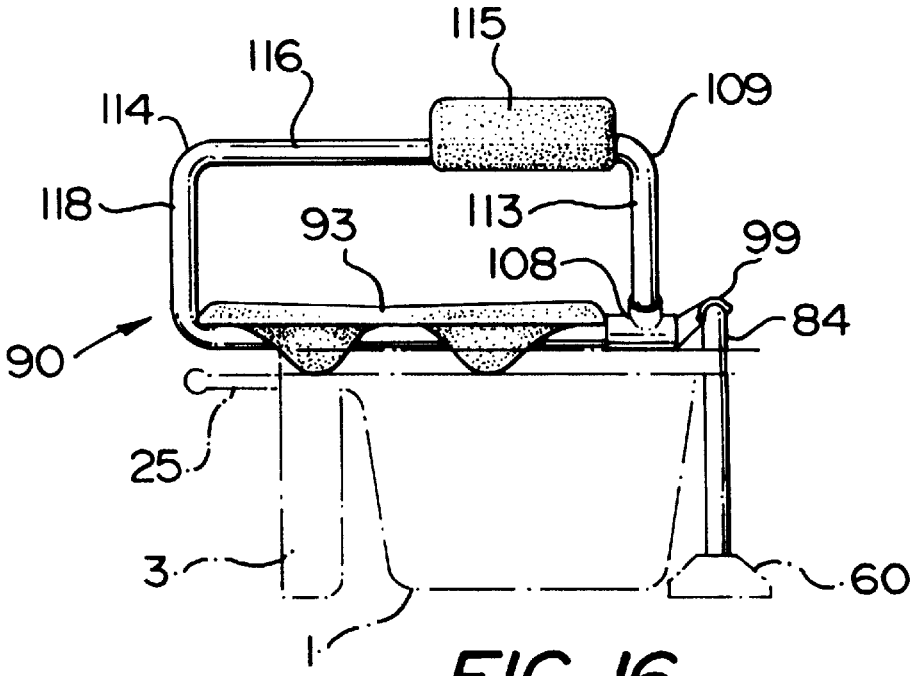
FIG. 16 is an end view of the accessories of FIGS. 14 and 15.
Figure 17:
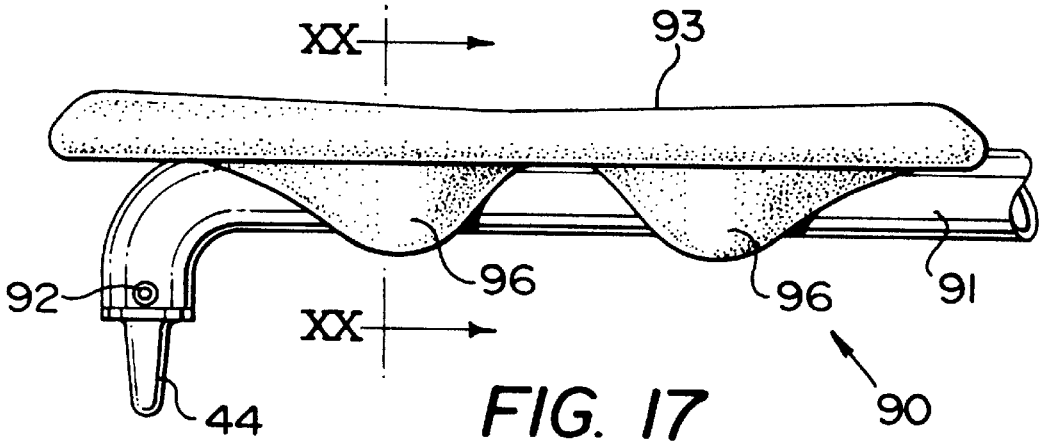
FIG. 17 is a side view of all but one end of a seat assembly used on the bathtub of FIGS. 1 to 5.
Figure 18:
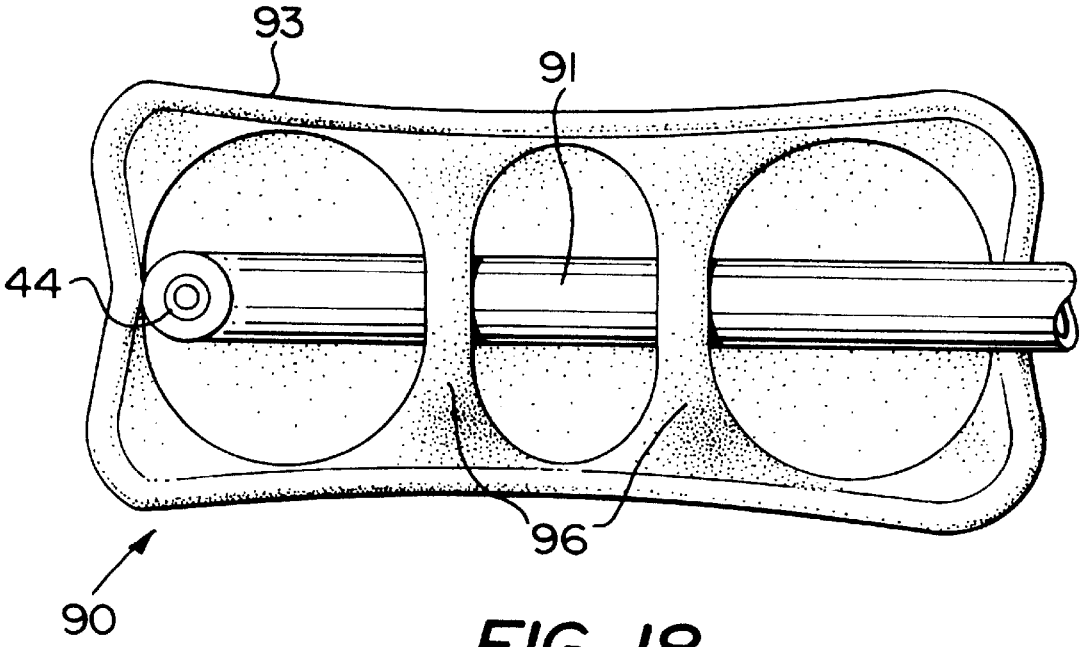
FIG. 18 is a bottom view of the seat assembly of FIG. 17.
Figure 19:
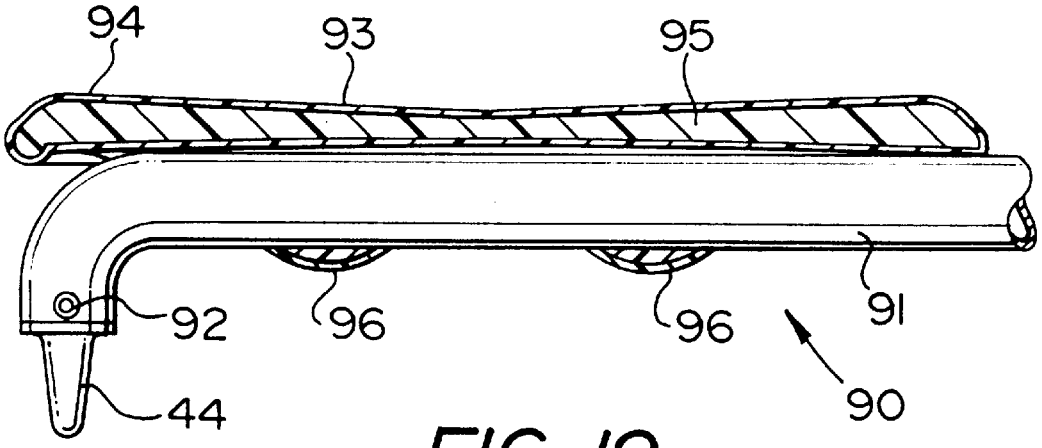
FIG. 19 is a longitudinal sectional view of the seat assembly of FIG. 17.
Figure 20:
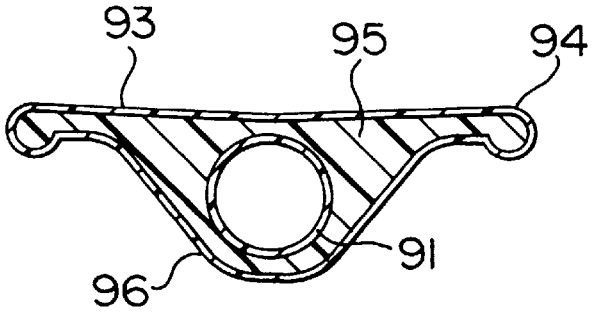
FIG. 20 is a cross section taken generally along line XX—XX of FIG. 17.
Figure 21:
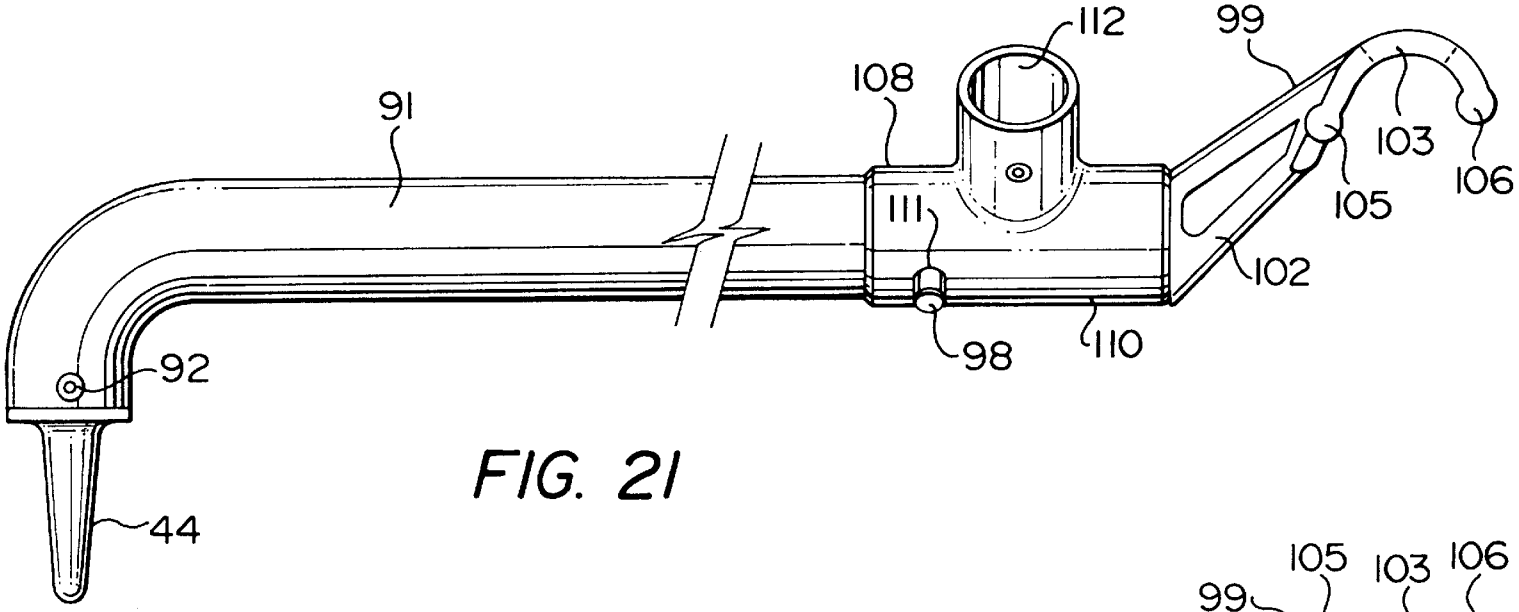
FIG. 21 is a side view of a support structure used in the seat assembly of FIGS. 17 to 20.
Figure 22:
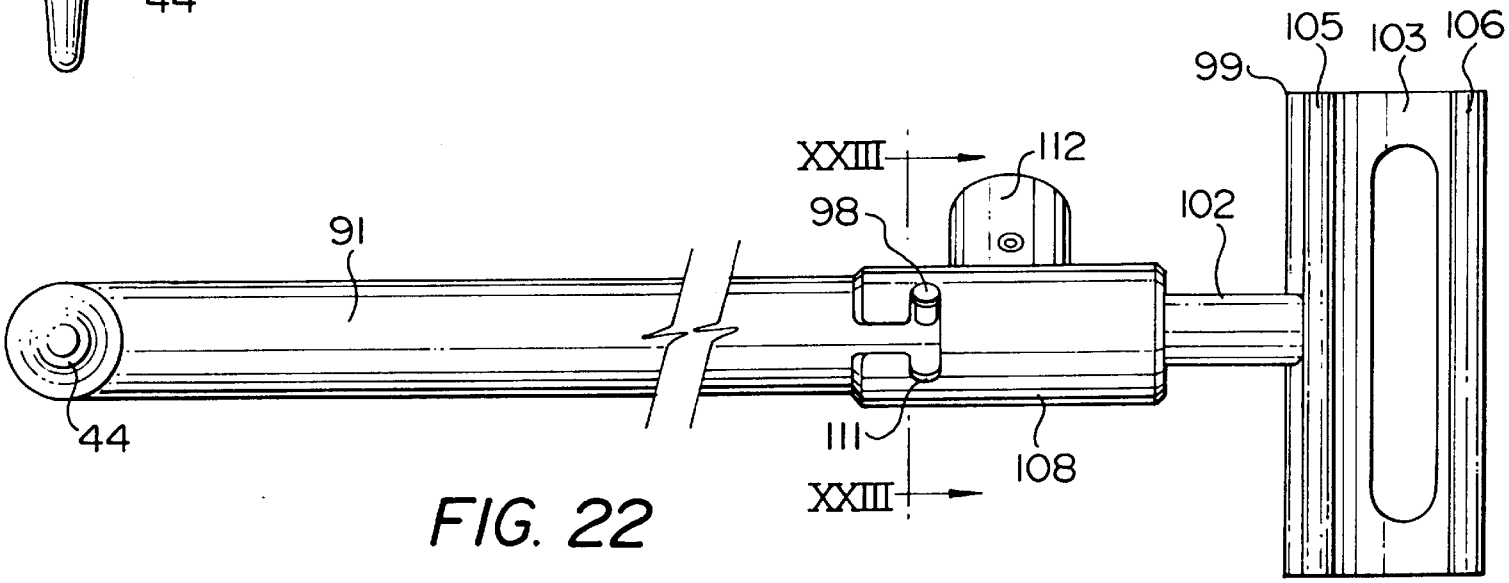
FIG. 22 is a bottom view of the support structure of FIG. 21.

As shown in FIGS. 14 to 16, the railing 70 can be replaced by a shorter L-shaped railing 84, the ends of which are seated in the sockets 26 proximate the rear center of the bathtub and the front right corner. The railing includes posts 85 and 86, and an L-shaped rail 87 extending between the tops of the posts. A polygonal cross section pad 88 defining a headrest is mounted on the rail 87 at the round end of the bathtub.

The railing 84 is used to support one end of a seat assembly generally indicated at 90. Referring to FIGS. 14 and 17 to 22, the seat assembly 90 includes an L-shaped tubular support arm 91, one end of which is pivotally mounted in the platform 25 by means of a plug 44, and the other end of which is supported by the railing 84. The plug 44 extends into the open top end of the tube and is connected thereto by a rivet 92.

Figure 23:
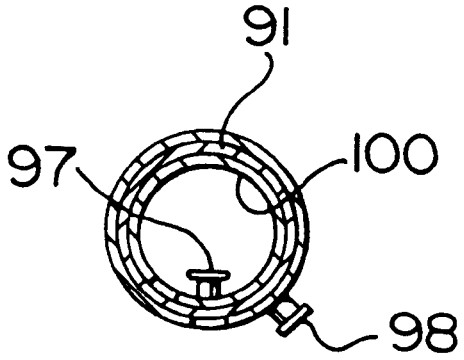
FIG. 23 is a cross section taken generally along line XXIII—XXIII of FIG. 22.
Figure 24:
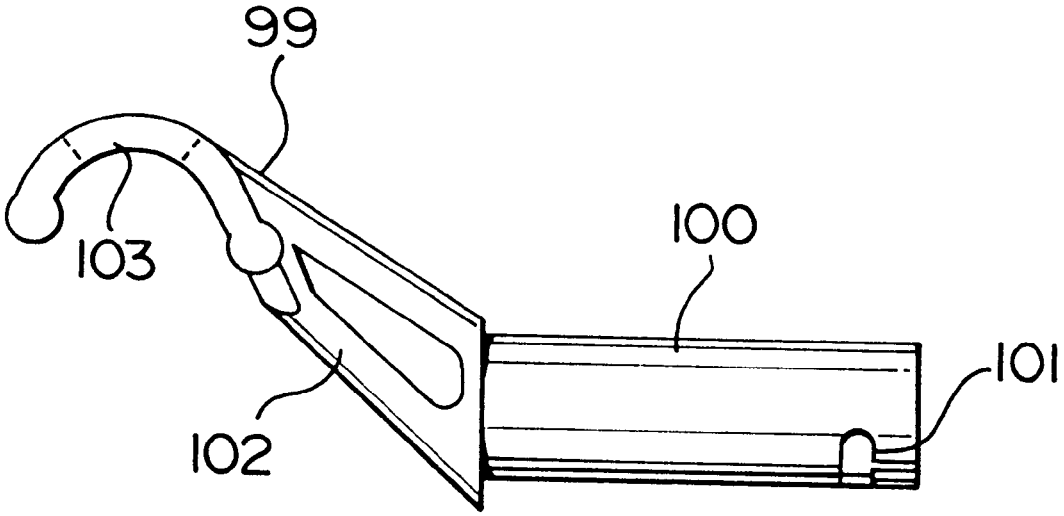
FIG. 24 is a side view of a bracket used in the support structure of FIGS. 21 and 22.

A generally rectangular panel 93 defined by a rigid skin 94 and foam interior 95 (FIGS. 19 and 20) is mounted on the arm 91. The arm 91 extends through projections 96 on the bottom of the panel 93. A pair of pins 97 and 98 (FIGS. 22 to 24) are provided near the other end of the arm 91, one pin 97 on the inside and one pin 98 on the outside of the arm. The pin 97 is used to connect a bracket 99 to the support arm 91 for supporting the rear or inner end of the seat on the railing 84. The bracket 99 includes a tube 100 extending into the arm 91. A T-shaped slot 101 in the inner end of the tube 100 receives the pin 97. By rotating the bracket 99 with the pin 97 fully in the slot 101, the bracket 99 is releasably locked in the arm 91. An inclined arm 102 extends upwardly from the other end of the tube 100 to an elongated saddle 103 of generally C-shaped cross section. The saddle 103 includes beaded inner and outer edges 105 and 106. The saddle 103 sits on the railing 84 to releasably support one end of the seat assembly 90 on the railing. With this structure, the seat assembly can be released from the railing 84 merely by lifting the saddle 103 from the railing. The seat assembly can then be rotated around the longitudinal axis of the plug 44 from the use position to a non-use position over the ledge 25 or extending outwardly from the front edge of the bathtub. It will be appreciated that the release and pivoting action can be effected from inside or outside the bathtub.

The outer pin 98 is used to retain a T-connector 108 on the support tube 91. The connector 108, which is used to mount a backrest 109 (FIGS. 14 to 16) on the seat assembly, includes a sleeve 110 with a T-shaped slot 111 in one end thereof for receiving the exterior pin 98 on the tube 91. A tubular stem 112 extends outwardly from the sleeve 110 for receiving one inclined arm 113 of a generally C-shaped backrest frame 114. A polygonal pad 115 is mounted on the upper, horizontal arm 116 of the frame 114. A front, L-shaped arm 118 of the frame 114 extends downwardly and inwardly toward the center of the bathtub, and finally rearwardly beneath the seat panel 93, stopping short of the support arm 91.

As best shown in FIG. 15, the assembly 90 and the backrest 109 can be mounted on the bathtub above the center thereof, or by removing the backrest 109 from the seat, the two can be stored beneath the platform 25. In order to remove the backrest 109 from the seat, the bracket 99 is rotated to align the pin 97 with the stem of the T-shaped slot 101, and the bracket 99 is pulled out of the support tube 91. The T-connector 108 is then removed from the support tube 91, so that the two elements (the seat assembly and the backrest) can be moved together to form a more compact unit for storage. In the storage position, the saddle 103 engages a post 42 at one end of the bathtub, and the arm 113 of the backrest 109 extends downwardly against the bottom edge of the seat panel 93, and the free end thereof is located behind the top end of the panel 93.

We claim:

1. A bathtub comprising:

(a) a reservoir for receiving a person using the bathtub, said reservoir having an open top end and including a bottom wall, a front wall, a rear wall, and first and second end walls;

(b) a top wall integral with said front wall, said rear wall and said end walls, said top wall completely surrounding and extending horizontally outwardly from said open top end of the reservoir;

(c) an apron spaced apart from the front wall of the reservoir and extending downwardly from the top wall for supporting the top wall; said apron being bowed inwardly along the entire length thereof and defining the front of the bathtub;

(d) a planar, horizontal platform integral with said top wall at one end of the bathtub extending along slightly more than one-half of the length of the bathtub from one end thereof and cantilevered a substantial distance outwardly from the apron for supporting a person using the bathtub;

(e) a narrow ledge integral with the top wall at a second end of the bathtub extending from said platform to the other end of the bathtub and cantilevered outwardly from the apron; and (f) a concave depression in said ledge facilitating access to said bathtub by a person seated on said platform.

2. A bathtub according to claim 1 wherein said front and rear walls are slightly concave, bowing inwardly from said first end wall to said second end wall; said first end wall being straight and said second end wall being semicircular, said bottom wall being widest at said first end wall.

3. A bathtub according to claim 2, wherein said first end wall slopes steeply upwardly and outwardly from said bottom wall, and said front wall, rear wall and second end wall slope more gently upwardly and outwardly from said bottom wall to said top wall.

4. A bathtub according to claim 1, including a beaded edge extending continuously along said platform and said ledge, said beaded edge defining the front edge of the bathtub.

5. A bathtub according to claim 1, including a railing for removable mounting on said top wall, said railing extending around at least one rear corner of said top wall; and first sockets at the corners and the rear center of said top wall for releasably supporting said railing.

6. A bathtub according to claim 5, including a base support for positioning on a floor beneath said first sockets for receiving and supporting a bottom end of said railing.

7. A bathtub according to claim 5, including a seat for removable mounting on said top wall; and second sockets in said platform for releasably supporting one end of said seat.

8. A bathtub according to claim 7, including an inverted U-bar for removable mounting on said platform proximate said ledge to facilitate entry and exiting of the bathtub; and third sockets for releasably supporting both bottom ends of said inverted U-bar.

9. A bathtub according to claim 8, wherein said second and third sockets in said platform include projections extending downwardly from said platform; reinforcing inserts in said projections; and plugs on said one end of said seat and on free bottom ends of said inverted U-tube for insertion into said sockets.

10. A bathtub according to claim 7, wherein said seat includes a panel for supporting a person using the bathtub; an arm attached to said panel; a plug in one end of said arm for insertion into said second sockets; and a bracket on the other end of said arm for resting on said railing with the panel extending transversely of the bathtub.

11. A bathtub according to claim 10, including a backrest; and a connector for releasably mounting said backrest on said arm.

* * * * *